US011202551B2

(12) United States Patent
Marzorati

(10) Patent No.: US 11,202,551 B2
(45) Date of Patent: Dec. 21, 2021

(54) DISHWASHER

(71) Applicant: ELECTROLUX APPLIANCES AKTIEBOLAG, Stockholm (SE)

(72) Inventor: Luca Marzorati, Porcia (IT)

(73) Assignee: Electrolux Appliances Aktiebolag

( * ) Notice: Subject to any disclaimer, the term of this patent is extended or adjusted under 35 U.S.C. 154(b) by 414 days.

(21) Appl. No.: 16/309,718

(22) PCT Filed: Jun. 30, 2016

(86) PCT No.: PCT/EP2016/065405
§ 371 (c)(1),
(2) Date: Dec. 13, 2018

(87) PCT Pub. No.: WO2018/001496
PCT Pub. Date: Jan. 4, 2018

(65) Prior Publication Data
US 2019/0133409 A1 May 9, 2019

(51) Int. Cl.
*A47L 15/42* (2006.01)

(52) U.S. Cl.
CPC ..... *A47L 15/4265* (2013.01)

(58) Field of Classification Search
CPC ..... A47L 15/4265
See application file for complete search history.

(56) References Cited

U.S. PATENT DOCUMENTS

2004/0201337 A1 10/2004 Wuestefeld et al.
2007/0188059 A1 8/2007 Davis et al.
2010/0051072 A1 3/2010 Brambilla
(Continued)

FOREIGN PATENT DOCUMENTS

CN 101160086 A 4/2008
CN 101688745 A 3/2010
CN 203122330 U 8/2013
(Continued)

OTHER PUBLICATIONS

International Search Report and Written Opinion for Application No. PCT/EP2016/065405 dated Feb. 24, 2017, 10 pages.
(Continued)

*Primary Examiner* — Jason Y Ko
(74) *Attorney, Agent, or Firm* — RatnerPrestia

(57) ABSTRACT

A dishwasher may include a frame defining a treatment chamber for items to be washed; a door for selectively accessing the treatment chamber, the door including a door panel; and at least one coupling system for coupling a decorative front panel to the door panel. The at least one coupling system may include a support member coupled to the door panel; a sliding member coupled to the decorative front panel and slidably coupled to the support member for sliding with respect and parallel thereto, such that the sliding of the sliding member with respect to the support member causes the sliding of the decorative front panel with respect to the door panel; and a regulation group including a rotatable regulation member that can be rotated by a user and a conversion member coupled to the regulation member and to the sliding member for converting a rotation of the regulation member into the sliding of the sliding member.

13 Claims, 8 Drawing Sheets

(56) References Cited

U.S. PATENT DOCUMENTS

2015/0184928 A1 7/2015 Ozyuksel et al.

FOREIGN PATENT DOCUMENTS

| | | | | |
|---|---|---|---|---|
| CN | 204427974 | U | | 7/2015 |
| CN | 204468001 | U | | 7/2015 |
| CN | 105050452 | A | | 11/2015 |
| DE | 299 21 641 | U1 | | 8/2000 |
| EP | 0647821 | A1 | | 4/1995 |
| EP | 1364609 | B1 | | 2/2004 |
| EP | 2 110 064 | A1 | | 10/2009 |
| EP | 2 407 723 | A1 | | 1/2012 |
| WO | 2010076200 | A1 | | 7/2010 |
| WO | WO2013/182428 | A1 | * | 12/2013 |
| WO | WO 2013/182428 | A1 | | 12/2013 |

OTHER PUBLICATIONS

Chinese Office Action for Chinese Application No. 201680086091.
2, dated May 31, 2021, 7 pages.

* cited by examiner

DISHWASHER

CROSS-REFERENCE TO RELATED APPLICATIONS

This application is a national stage application filed under 35 U.S.C. § 371 of International Application No. PCT/EP2016/065405 filed Jun. 30, 2016, which application is hereby incorporated by reference herein in its entirety.

FIELD OF THE INVENTION

The present invention generally relates to the field of appliances. More specifically, the present invention relates to appliances designed to be integrated with furniture pieces.

BACKGROUND OF THE INVENTION

Appliances are routinely used to accomplish a number of functions. Two main broad classes of appliances are available: freestanding appliances and integrated appliances. A freestanding appliance is available as a freestanding apparatus adapted to be operated without anything surrounding it, while an integrated appliance is an apparatus designed to be integrated with other pieces of furniture.

Typically, an integrated appliance is designed to be installed into a corresponding niche defined by other pieces of furniture. The integrated appliance is provided with a decorative front panel—normally with the same appearance of the surrounding pieces of furniture—which is mounted on the appliance itself. With reference in particular to a dishwasher integrated in a kitchen, the dishwasher is called of the built-in type when it has its control panel exposed or of the full-integrated type when it is completely covered by the corresponding decorative front panel; the dishwasher of the full-integrated type is indistinguishable from the adjacent pieces of furniture (and requires to be opened to access the control panel).

In order to deliver an aesthetically satisfactory appearance, the edges of the decorative front panel have to be aligned with those of panels/doors of the adjacent pieces of furniture (for example, the dishwasher decorative front panel should be flush with the other kitchen furniture panels when the dishwasher door is closed). For this purpose, in order to install an integrated appliance, additional care should be employed.

In order to achieve alignment of the edges of the decorative front panel with the edges of the panels/doors of the adjacent pieces of furniture, the known solutions require that an operator or a user lifts the decorative front panel in order to move it up or down and, when the desired alignment/position is reached, keeps it in position by hands while it is screwed to the dishwasher.

An example of solution based on such an approach is disclosed in EP2407723. EP2407723 discloses a hinge for use in a domestic appliance to rotationally connect a door of the appliance to a body of the appliance, wherein a decorative front panel can be mounted in front of the door and arranged slidably in an essentially orthogonal direction relative to a rotation axis of the door with respect to the body. The hinge disclosed in EP2407723 also allows a regulation for alignment by acting on the lateral screws of the hinge.

SUMMARY OF THE INVENTION

The Applicant has found that none of the known solutions is capable of providing a simplified procedure for an easy alignment of the edges of the decorative front panel of an appliance (such as a dishwasher) with those of panels/doors of the adjacent pieces of furniture.

In this respect, the Applicant has understood that the need of lifting the decorative front panel in order to move it up or down and of keeping it in position by hands while it is screwed to the dishwasher, makes the decorative front panel installation burdensome and long. Indeed, a number of attempts before reaching an acceptable alignment is often required.

In addition, the need of keeping the decorative front panel in position by hands when the desired alignment/position is reached, requires the assistance of one or more other operators or users for the screwing operation.

These issues are exacerbated in some unfavorable scenarios, such as when the dishwasher is located at an end of the kitchen, e.g. near a lateral wall. In this case, the reduced available space considerably limits the freedom of movement of both the operator or user in charge of lifting the decorative front panel and the operator or user in charge of screwing the decorative front panel to the dishwasher.

In view of the above, it is an object of the present invention to provide a coupling system, as well as a dishwasher (i.e., a full-integrated dishwasher) equipped with such a coupling system, for allowing fast and easy installation and regulation of the decorative front panel.

One or more aspects of the present invention are set out in the independent claims, with advantageous features of the same invention that are indicated in the dependent claims.

An aspect of the present invention relates to a dishwasher comprising:

a frame defining a treatment chamber for items to be washed, a door for selectively accessing the treatment chamber, the door comprising a door panel, at least one coupling system for coupling a decorative front panel to the door panel, the at least one coupling system comprising:

- a support member coupled to the door panel,
- a sliding member coupled to the decorative front panel and slidably coupled to the support member for sliding with respect and parallel thereto, such that the sliding of the sliding member with respect to the support member causes the sliding of the decorative front panel with respect to the door panel, and
- a regulation group comprising a rotatable regulation member that can be rotated by a user, and a conversion member coupled to the regulation member and to the sliding member for converting a rotation of the regulation member into said sliding of the sliding member.

According to an embodiment of the present invention, the sliding member comprises an engaging element for engaging a respective panel pin of the decorative front panel.

According to an embodiment of the present invention, the engaging element is a snap-fit element for the snap-fit engagement of said panel pin.

According to an embodiment of the present invention, the engaging element comprises at least first and second arms adapted to hold the panel pin therebetween.

According to an embodiment of the present invention, at least one of the first arm and the second arm comprises a grip portion adapted to manually separate the first arm and the second arm from each other thereby allowing release of the panel pin and decoupling of the decorative front panel from the door panel.

According to an embodiment of the present invention, the conversion member comprises a cylinder and, preferably, the regulation member comprises a regulation screw preferably fitted into a threaded hole of the cylinder along a first direction—the first direction being preferably orthogonal to a sliding direction of the sliding member. Advantageously, the sliding member comprises a guide, preferably extending along a second direction inclined with respect to the first direction and to the sliding direction, the guide being preferably adapted to slidably receive the cylinder, whereby the rotation of the regulation screw causes the cylinder to slide along the guide and the sliding of the cylinder determines the sliding of sliding member.

According to an embodiment of the present invention, the support member comprises a substantially U-shaped support member, preferably having opposite first and second walls projecting from respective edges of a third wall. The support member preferably comprises first and second sliding grooves at free ends of said first and second side walls, respectively. First and second edges of the sliding member are preferably designed to slidably engage said first and second sliding grooves, respectively, thereby allowing sliding of the sliding member along them.

According to an embodiment of the present invention, the door panel comprises at least one slot allowing the passage of a respective panel pin through it, each slot preferably extending between a rear face of the door panel facing the treatment chamber when the door is closed and a front face of the door panel opposite the rear face. Each coupling system is preferably arranged at the rear face of the door panel in correspondence of a respective slot so as to engage the respective panel pin protruding from the rear face of the door panel upon its passage through the slot.

According to an embodiment of the present invention, said at least one slot has an enlarged end portion for allowing passage of a head portion of a respective panel pin therethrough, and, preferably, an elongated portion for allowing movement/sliding of a rod portion of the panel pin along it, the sliding of the sliding member being allowed by the sliding of the panel pin along the slot.

According to an embodiment of the present invention, the support member comprises a housing for housing the regulation member and, preferably, allowing an idle rotation thereof.

According to an embodiment of the present invention, said housing comprises a first and a second slots formed at the first and second side walls of the support member, respectively.

According to an embodiment of the present invention, the support member comprises an eyelet extending from a bottom edge of the support member, said eyelet being preferably adapted to receive a fastening member for fastening the support member to the door panel.

According to an embodiment of the present invention, the coupling system is fixed to the rear face of the door panel.

According to an embodiment of the present invention, the dishwasher further comprises at least one door hinge for rotationally coupling the door to the frame, the at least one coupling system being preferably fixed to a respective door hinge.

DETAILED DESCRIPTION

Figure 1A:
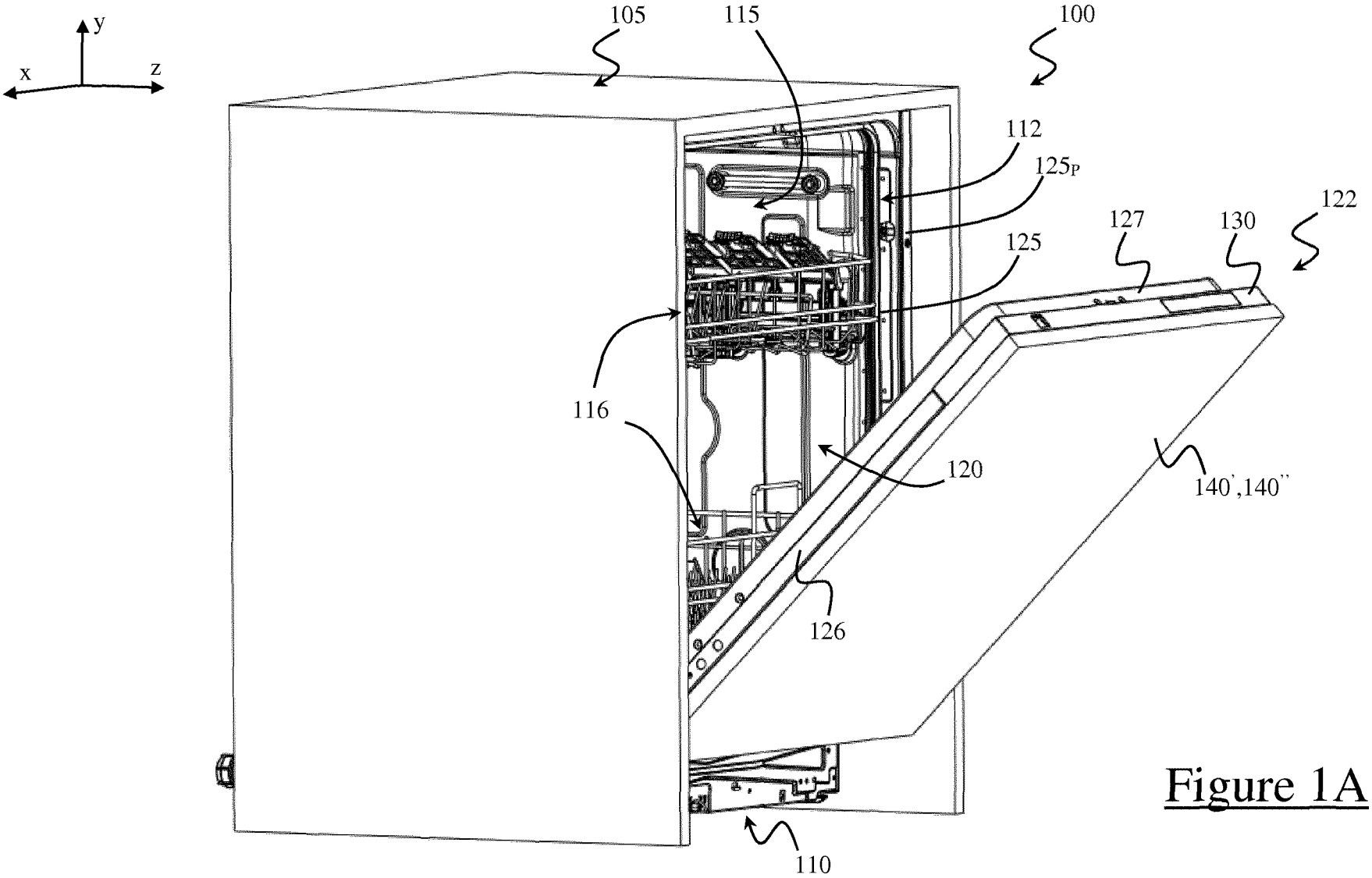
FIG. 1A is a perspective view of a dishwasher according to an embodiment of the present invention.

With reference to FIG. 1A, it shows a perspective view of a dishwasher 100 according to an embodiment of the present invention. In the following, directional terminology (such as top, bottom, front, rear, central and side) is only used for describing the dishwasher 100 and components thereof according to their orientation in the figures and the intended orientation use thereof, therefore directional terminology should be under no circumstances construed in absolute terms. Moreover, for the purposes of the present description, when an entity is said to be "fastened" or "fixed" to another entity, it means that said two entities cannot move relative to each other.

The dishwasher 100 preferably comprises a base 110 for resting the dishwasher 100 on a support surface (not shown in the figures), parallel to the plane defined by orthogonal directions x and z, such as a floor or a support surface of a suitable niche 105 of a piece of furniture wherein the dishwasher 100 can be installed (for example, as assumed from now on, a kitchen furniture).

The dishwasher 100 also comprises a, e.g. parallelepiped shaped, body or frame 112 defining a (e.g., hollow) treatment chamber 115 with one or more pullout racks 116, for inserting items to be washed (for example, dishes, cutlery, glasses, pots, pans, and the like). The treatment chamber 115 has a front load opening 120 (parallel to the plane defined by orthogonal directions x and y), closable by a door 122 (the door 122 being exemplary shown partially opened in the figure), thus the door 122 allowing to selectively access the treatment chamber 115.

The frame 112 preferably comprises top and bottom walls parallel to the plane defined by directions x and z, a rear wall parallel to the front load opening 120 (i.e., parallel to the plane defined by directions x and y), and two side walls 125 orthogonal to the top, bottom and rear walls (i.e., parallel to the plane defined by directions y and z). The external faces of the side walls 125, i.e., the faces thereof that do not face the treatment chamber 115, are usually covered by external side panels (only one visible in the figure and denoted by the number reference 125*p*).

The door 122 preferably comprises an outer door panel 126 and an inner door panel 127.

Preferably, the inner door panel 127 is mounted on a rear face of the outer door panel 126, the rear face of the outer door panel 126 facing the treatment chamber 115 when the 122 door is closed. More preferably, the outer 126 and inner 127 door panels are sized such that, upon outer 126 and inner 127 door panels mounting, a portion (preferably, a perimeter edge portion) of the rear face of the outer door panel 126 is uncovered by the inner door panel 127 and acts as an abutment portion (preferably, a perimeter abutment portion) abutting against borders of the front load opening 120 to seal the treatment chamber 115 when the door 122 is closed.

The door 122 preferably comprises a control panel 130, which may be mounted on top of the outer door panel 126, for example flush therewith, so as to be aligned with a top of the frame 112.

Preferably, the door 122 is rotationally coupled to the base 110 by means of one or more door hinges (not visible in such a figure), so that the door 122 can rotate with respect to the frame 112 around a horizontal rotation axis (raised from the floor), parallel to direction x. Particularly, the door 122 can be opened, preferably with a drop-down movement, so as to access the treatment chamber 115 in order to insert the items to be washed and/or to remove the items being washed. The door 122 can be closed, preferably with a pull-up movement, to enable the operation of the dishwasher 100.

The dishwasher 100 is of the full-integrated type, so as to be totally indistinguishable from other pieces of the kitchen furniture where it is installed (and when the door 122 is closed). For this purpose, upon installation, the door 122 is coupled to a decorative front panel so as to be completely covered by it, the decorative front panel being not part of the dishwasher 100 (the decorative front panel being typically made of wood and, usually, with same appearance as, or at least coordinated with, the other pieces of the kitchen furniture). Preferably, the decorative front panel is longer than the door 122, so that it projects below the door 122, and the base 110 preferably has a front recess for avoiding interference of the decorative front panel with the base 110 when the door 122 is opened.

Figure 1B:
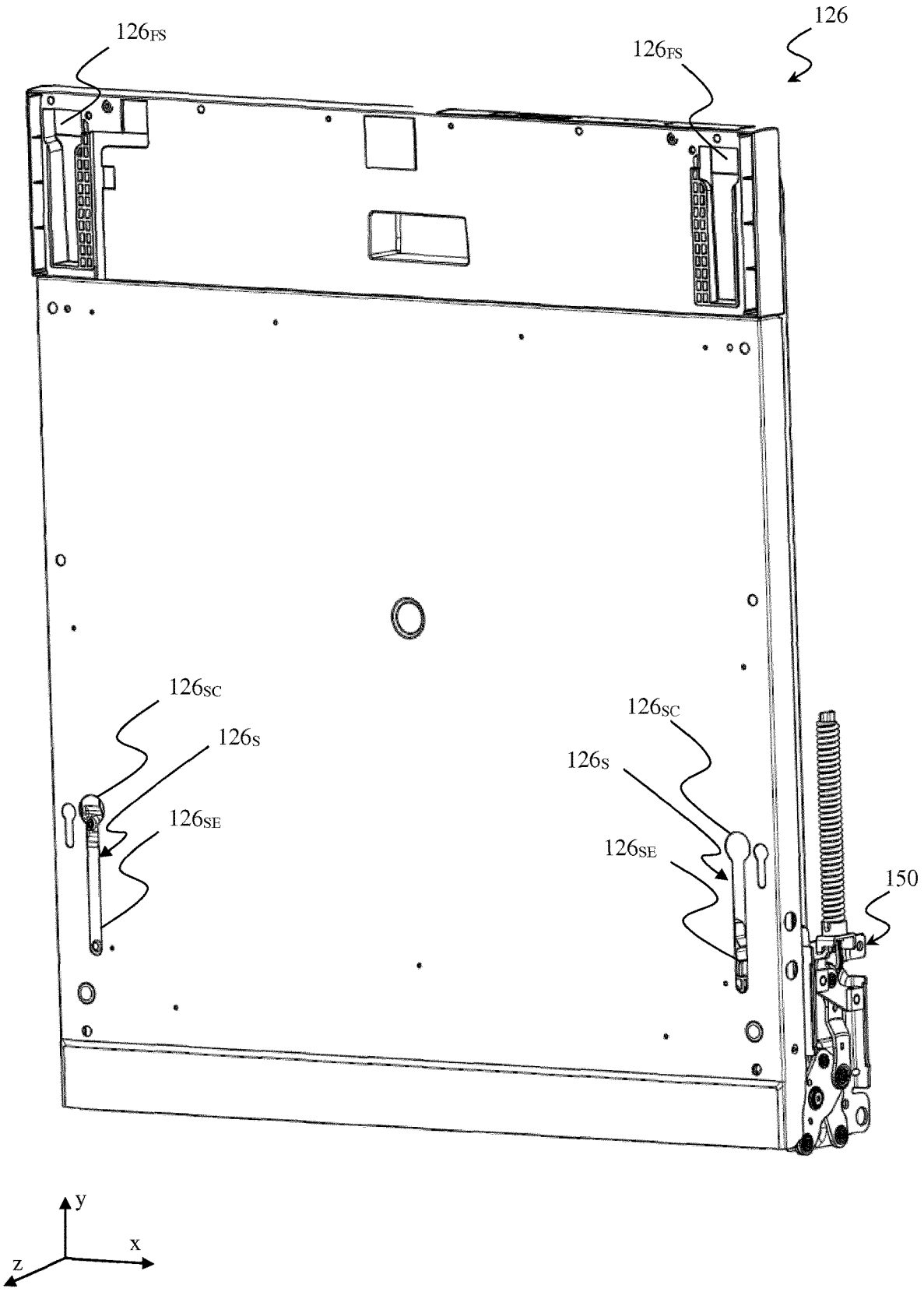
FIG. 1B is a perspective view of an outer door panel of the dishwasher according to an embodiment of the present invention.
Figure 1C:
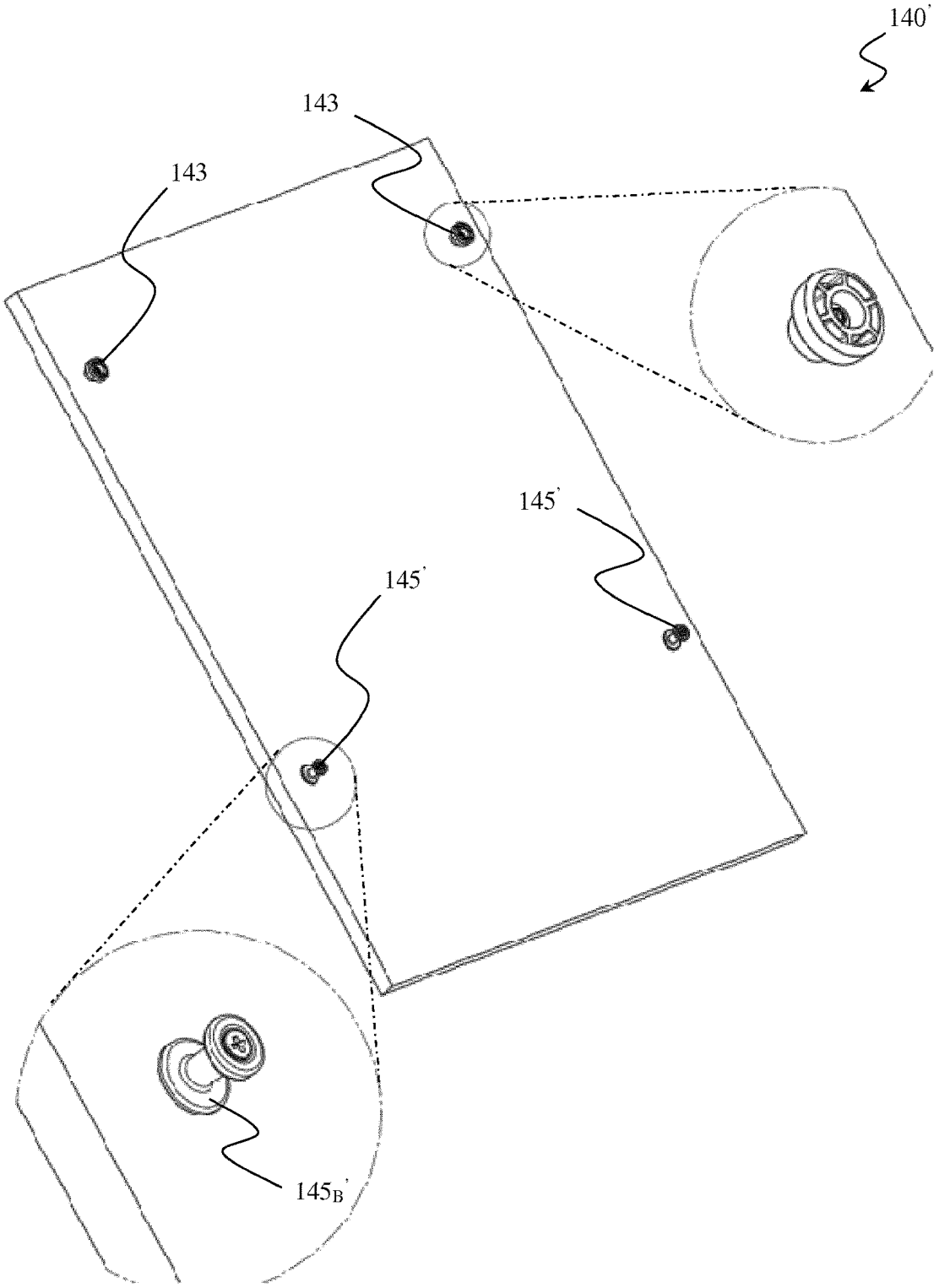
FIGS. 1C and 1D show perspective views of rear faces of decorative front panels that can be mounted on the dishwasher.
Figure 1D:
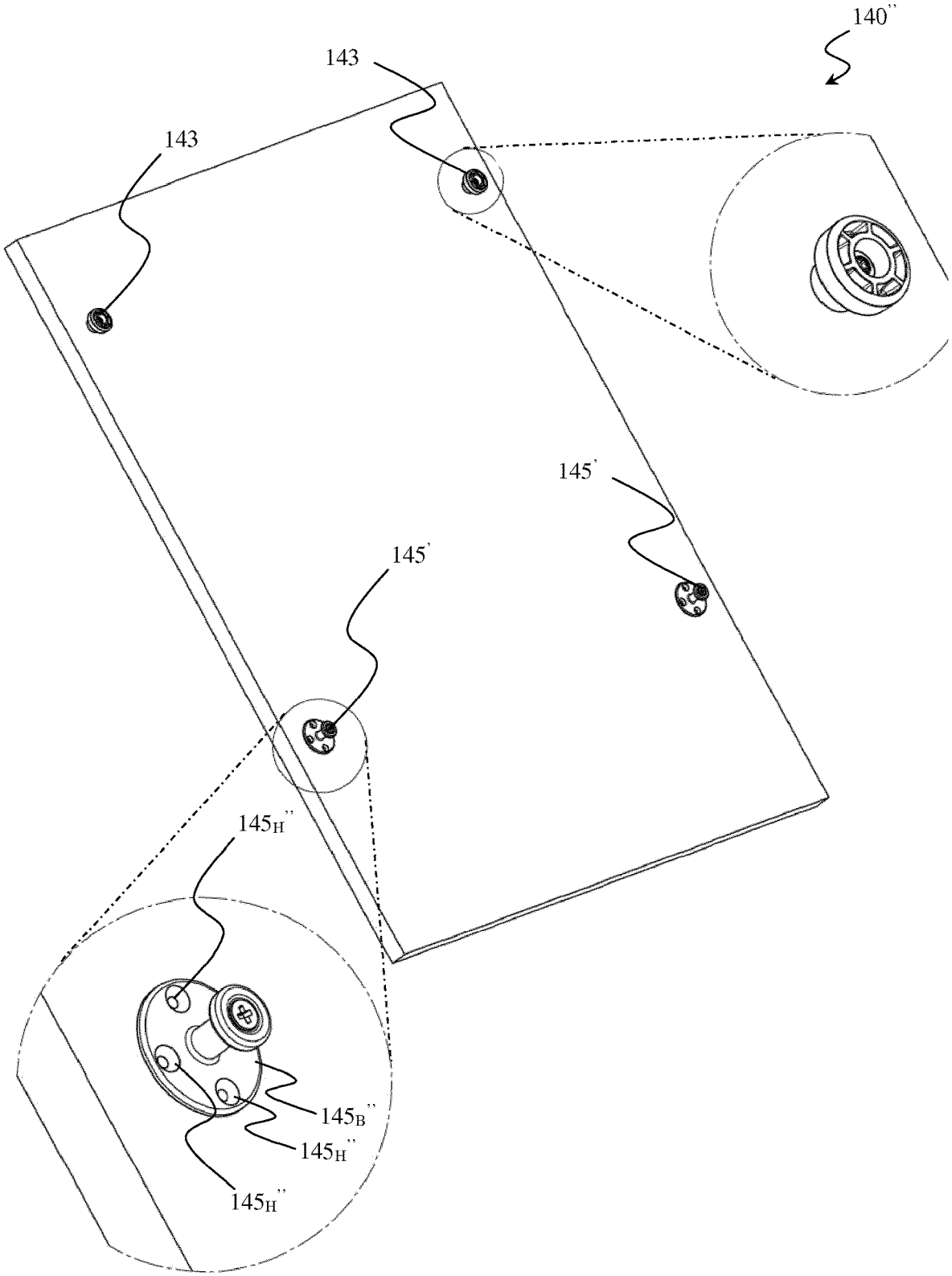

FIGS. 1C and 1D show perspective views of rear faces of decorative front panels (according to respective embodiments) that can be coupled to the dishwasher 100 (the rear face of the decorative front panel facing, in operation, a front face of the outer door panel 126). In these figures, the decorative front panels are denoted by the same number reference 140, but are differentiated by apex and respectively. For the sake of conciseness, when distinguishing between the decorative front panels embodiments of FIGS. 1C and 1D is not necessary, the decorative front panels or each decorative front panel will be denoted by the reference 140',140" (as also indicated in FIG. 1A).

The decorative front panel 140',140" comprises, at the rear face thereof, a number of panel pins for coupling thereof to the outer door panel 126, as discussed below. According to the illustrated embodiments, four panel pins are provided, e.g. two panel pins 143 (hereinafter referred to as top panel pins) arranged at a top region (of the rear face) of the decorative front panel 140',140", preferably at opposite edges thereof, and two panel pins (hereinafter referred to as bottom panel pins) arranged at a substantially bottom region (of the rear face) of the decorative front panel 140',140", preferably at opposite edges thereof. Similarly to the above, in FIGS. 1C and 1D the bottom panel pins are denoted by the same number reference 145, but are differentiated by apex and respectively (indeed, as discussed herebelow, the decorative front panels 140',140" differ from each other for the implementation of the respective bottom panel pins 145' and 145").

For the sake of conciseness, when distinguishing between the bottom panel pins embodiments of FIGS. 1C and 1D is not necessary, the bottom panel pins or each bottom panel pin will be denoted by the reference 145',145".

Preferably, as illustrated, the top panel pins 143 are the same in both decorative front panels 140',140", although this should not be construed limitatively. In the exemplary illustrated embodiments, both top 143 and bottom 145',145" pins are dome-head pins (i.e., each one having a pillar or rod portion and an enlarged head portion at an end thereof) extending, in length, perpendicularly from the rear face of the decorative front panel 140',140".

Preferably, the rod portion of the bottom panel pins 145',145" is longer than that of the top panel pins 143. This because the bottom panel pins 145',145" (and, particularly, the rod portions thereof) are preferably designed to allow mounting of the respective decorative front panels 140',140" to the door 122 (and, specifically, to the outer door panel 126 by means of one or more coupling systems mounted at the rear face thereof, as better discussed in the following).

Even more preferably, as visible in FIGS. 1C and 1D, and particularly to the enlarged views of the bottom panel pins 145',145", the bottom panel pin 145',145" comprises a screw (e.g., a metal screw) covered by a cladding (for example, made of a plastic material), with the screw body (and the respective cladding portion covering it) and the screw head (and the respective cladding portion covering it) that form, respectively, the rod portion and the enlarged head portion of the bottom panel pin 145',145". The provision of the screw makes the bottom panel pin 145',145" able to bear the mechanical stress acting on it when the decorative front panels 140',140" is moved with respect to the door 122 (as better discussed in the following), whereas the cladding avoids that the hardness and the cutting edges portions of the screw, such as its thread, damage the coupling system to which it is intended to be engaged.

Preferably, as visible in FIGS. 1C and 1D, each bottom panel pin 145',145" further comprises a (e.g., disc-shaped) base portion $\mathbf{145}_B'$,$\mathbf{145}_B''$, preferably fixed to the rear face of the decorative front panel 140',140". More preferably, as illustrated, the base portion $\mathbf{145}_B'$,$\mathbf{145}_B''$ substantially surrounds the point in which the screw is inserted in the decorative front panel 140',140", so as to improve mechanical resistance of the bottom panel pin 145',145".

With reference now to FIG. 1D, and particularly to the enlarged view of the bottom panel pin 145", the bottom panel pin 145" differs from the bottom panel pin 145' in that the base portion $\mathbf{145}_B''$ has at least one hole $\mathbf{145}_H''$ (for example, as illustrated, three holes $\mathbf{145}_H''$) each one for insertion of a respective screw (not shown) aimed at compensating possible structural failures of the decorative front panel 140" (such as those structural failures that could cause detachment of the bottom panel pin 145" from the decorative front panel 140").

With reference also to FIG. 1B, it shows a perspective view of the outer door panel 126 according to an embodiment of the present invention. In this figure, a door hinge, denoted by the number reference 150, is also partially visible.

As visible in the figure, the door 122, and preferably the outer door panel 126, preferably comprises one or more slots $\mathbf{126}_S$ each one allowing the passage of a respective bottom panel pin 145',145" therebetween. Preferably, as illustrated, each slot $\mathbf{126}_S$ is a through-slot extending between the front and rear faces of the outer door panel 126. In the exemplary considered embodiment, two slots $\mathbf{126}_S$ are provided, which are preferably arranged at opposite edges of a lower portion of the outer door panel 126. Even more preferably, the slots $\mathbf{126}_S$ are provided at the abutment portion of the outer door panel 126 (such that, when the door 122 is closed and the abutment portion abuts against borders of the front load opening 120 to seal the treatment chamber 115, washing liquids are prevented from escaping from the treatment chamber 115 through the slots $\mathbf{126}_S$). Still more preferably, the slots $\mathbf{126}_S$ are provided at opposite edges of the abutment portion of the outer door panel 126, so as to allow easy and fast mounting of the decorative front panel 140',140" (as discussed below).

According to the exemplary considered embodiment, each slot $\mathbf{126}_S$ has an elongated portion $\mathbf{126}_{SE}$ extending along the direction y (taking the door completely closed as reference), and an enlarged (e.g., circular) end portion $\mathbf{126}_{SC}$ (for example, arranged at the top end of the respective elongated portion $\mathbf{126}_{SE}$). The enlarged end portion $\mathbf{126}_{SC}$ of each slot $\mathbf{126}_S$ is preferably designed to allow passage of the head portion of a respective bottom panel pin 145',145" through it, whereas the elongated portion $\mathbf{126}_{SE}$ of each slot $\mathbf{126}_S$ is preferably designed to allow movement/sliding of the rod portion of the bottom panel pin 145',145" along it, and hence the movement/sliding of the decorative front panel 140',140" with respect to, and parallel to, the outer door panel 126 (the length of the elongated portion $\mathbf{126}_{SE}$ thus depending on the desired extent of the movement/sliding of the decorative front panel 140',140").

For the sake of completeness, further slots $\mathbf{126}_{FS}$ (shown in FIG. 1B) are advantageously provided at opposite edges of a top portion of the outer door panel 126, each further slot $\mathbf{126}_{FS}$ allowing a respective top panel pin 143 to move/slide along it while the bottom panel pins 145',145" are moved along the slots $\mathbf{126}_S$. According to an embodiment of the present invention, the further slots are similar in shape to the slots $\mathbf{126}_S$.

As mentioned above, the dishwasher 100 also comprises a coupling system, or more thereof, for mechanically coupling the decorative front panel 140',140" to the outer door panel 126 (and, hence, to the door 122) and for easily and reliably allowing the movement/sliding (and, hence, the regulation of the position) of the decorative front panel 140',140" with respect to the outer door panel 126 (and, hence, with respect to the door 122) along the slots $\mathbf{126}_S$.

In the considered embodiment, two coupling systems are provided, each one intended to attain the mechanically coupling between the decorative front panel 140',140" and the outer door panel 126 by engaging a respective bottom panel pin 145',145" (as detailed below). In order to achieve that, each coupling system is preferably configured to be arranged at the rear face of the outer door panel 126. More preferably, each coupling system is configured to be arranged in correspondence of a respective slot $\mathbf{126}_S$, so as to intercept (and, preferably, engage) the bottom panel pin 145',145" protruding from the rear face of the outer door panel 126 upon its passage through the slot $\mathbf{126}_S$. According to embodiments of the present invention, discussed in the following, the coupling system may be fixed either to the door hinge 150 or directly to the rear face of the outer door panel 126.

Figure 2A:
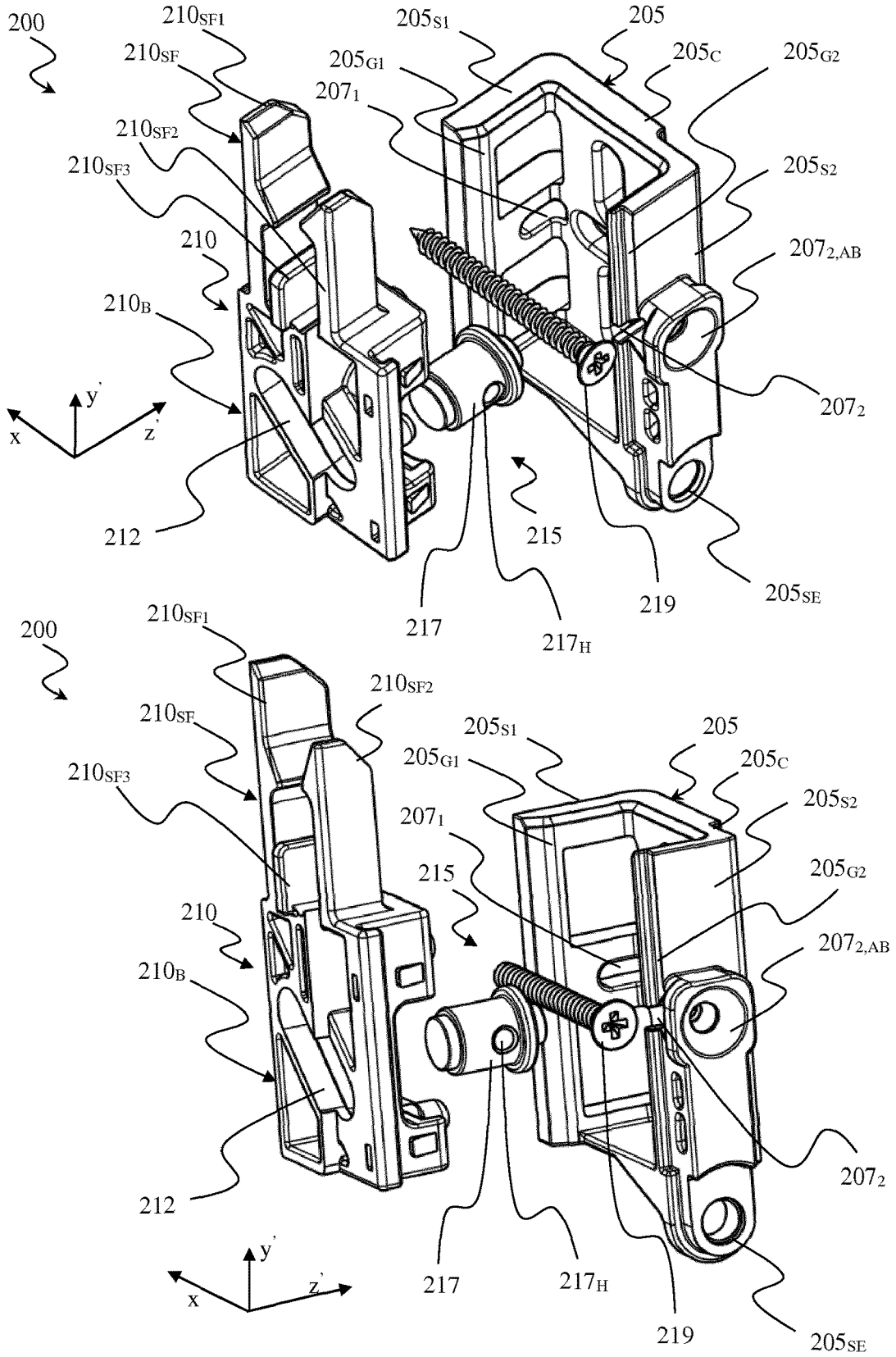
FIG. 2A shows exploded perspective views of a coupling system of the dishwasher according to an embodiment of the present invention.

With reference now to FIG. 2A, it shows exploded perspective views of a coupling system 200 of the dishwasher 100 according to an embodiment of the present invention. For ease of description, FIG. 2A will be discussed together with FIG. 2B, which show a perspective enlarged view of the coupling system 200, and with FIGS. 2C-2D, which show sectional views of the coupling system 200 in two different operating conditions (the sectional views of FIG. 2C having opposite viewpoints than the sectional views of FIG. 2D).

In the following, in order to discuss the orientation of the coupling system 200 with respect to the dishwasher 100, reference will be made to direction x (as above), and to directions y' and z'. As will be understood from the following description, the coupling system 200, when mounted on the door 122 (or on the door hinge 150), is integral with the door 122 (i.e., it is simultaneously moved with the door 122), so that the directions y' and z' correspond to the directions y and z when the door 122 is closed (when instead the door 122 is at least partially opened, the direction y' denotes the direction of the door 122 in its actual position).

According to an embodiment of the present invention, the coupling system 200 comprises:

- a support member 205, e.g. a substantially U-shaped support member having a central wall $\mathbf{205}_C$ and opposite side walls $\mathbf{205}_{S1}$,$\mathbf{205}_{S2}$ projecting from respective edges of the central wall $\mathbf{205}_C$, for allowing the coupling system 200 to be fixed to the dishwasher 100. The coupling system 200 is for example fixed either to the door hinge 150 or to the rear face of the outer door panel 126 (as mentioned above), so as to be integral with respect to the door 122 (i.e., so as to move simultaneously with it). In alternative embodiments of the present invention, not shown, the support member 205 is made in a single piece with the outer door panel 126;
- a sliding member 210 slidably coupled to the support member 205 for sliding with respect and parallel thereto. The sliding member 210 is also coupled to the decorative front panel 140',140", such that the sliding of the sliding member 210 with respect to the support member 205 causes the sliding of the decorative front panel 140',140" with respect to the door 122 (along the slots $\mathbf{126}_S$);
- a regulation group 215 for allowing easy and fast (and fine) regulation of the sliding of the sliding member 210 (and, hence, of the decorative front panel 140', 140").

In order to achieve sliding coupling between sliding member 210 and the support member 205, the support member 205 preferably comprises first $\mathbf{205}_{G1}$ and second $\mathbf{205}_{G2}$ sliding grooves extending along the direction y at free ends of its side walls $\mathbf{205}_{S1}$,$\mathbf{205}_{S2}$, respectively.

Advantageously, the edges of the sliding members are designed to slidably engage the first $\mathbf{205}_{G1}$ and second $\mathbf{205}_{G2}$ sliding grooves, thus allowing the sliding of the sliding members along them. According to the preferred, not limiting, illustrated embodiment, the first sliding groove $\mathbf{205}_{G1}$ is in the form of channel (for example, as illustrated, a single channel) facing an inner side of the support member 205 (i.e., the side that houses sliding member 210 and the regulation group 215), a first edge of the sliding member 210 (not visible) being shaped such as to be fitted into the first sliding groove $\mathbf{205}_{G1}$ and to slide along it. According to the preferred, not limiting, illustrated embodiment, the second sliding groove $\mathbf{205}_{G2}$ is in the form of channel (for example, as illustrated, two or more parallel channels) facing an outer side of the support member 205 and forming a flange at the free end of the side wall $\mathbf{205}_{S2}$, a second edge of the sliding member 210 (visible in FIG. 2B and in the top drawing of FIG. 2A) being shaped such as to be clamped on the second sliding groove $\mathbf{205}_{G2}$ and to slide on it (the second edge being for example substantially C-shaped). More preferably, the second edge of the sliding member 210 has, at a side thereof facing the parallel channels of the second sliding groove $\mathbf{205}_{G2}$ when clamping takes place, a number of parallel ridges (not visible) whose pattern substantially matches the pattern defined by the parallel channels, so that the fitting of each ridge on a respective channel ensure both reliable coupling and effective sliding.

In the exemplary embodiment of FIGS. 2A-2D, the regulation group 215 preferably comprises a rotatable regulation member (such as a regulation screw) 219 (e.g., made of a metal material or other rigid material) adapted to be screwed/unscrewed or rotated by the user or the operator, and a conversion member (for example, a cylinder) 217 (e.g., made of metal material or other rigid material) coupled to the regulation screw 219 and to the sliding member 210 for converting the rotation of the screw 219 into the sliding of the sliding member 210. Preferably, as illustrated, the regulation screw 219 is fitted into and a threaded hole $\mathbf{217}_H$ of the cylinder 217 (the regulation screw 219 rotation causing the sliding of the sliding member 210, as better discussed below). The threaded hole $\mathbf{217}_H$ (and, hence, the regulation screw 219 fitted therein) preferably extends along direction x—in any case, other directions may also be envisaged, e.g. in order to properly set the position and the accessibility of the regulation screw 219 for the operator or user (as discussed in the following). Broadly speaking, the regulation screw 219 prevents the cylinder 217 from rotating about its axis, while allowing it (with the help of/cooperation with a guide, as will be understood herebelow) to move only along the direction x. In alternative embodiments of the present invention, the regulation group 215 may be a different structure, arrangement or assembly for converting the rotatory movement of a screw (or of other rotatable member) into a translational movement (i.e., the sliding movement along the direction y').

Back to the illustrated embodiment, the sliding member 210 preferably comprises a substantially parallelepiped-shaped body $\mathbf{210}_B$ (that, in operation, represents a lower portion of the sliding member 210) having a guide 212 adapted to cooperate with the regulation group 215 for allowing and regulating the sliding of the sliding member 210 according to regulation screw 219 rotation (as discussed below). The sliding member body $\mathbf{210}_B$ may for example be made in a plastic or thermoplastic material. Alternatively, the sliding member body $\mathbf{210}_B$ may be made in in a metal material (e.g., by means of metal injection molding or other metalworking process).

Preferably, as illustrated, the first and second edges of the sliding member 210 intended to provide the sliding coupling with the first $\mathbf{205}_{G1}$ and second $\mathbf{205}_{G2}$ sliding grooves are opposite edges of the sliding member body $\mathbf{210}_B$.

In the exemplary considered embodiment wherein the regulation group 215 comprises the cylinder 217 and the regulation screw 219, the guide 212 is advantageously an inclined guide 212, being for example an elongated inclined guide. As can be better appreciated in FIG. 2A, the inclined guide 212 preferably extends, in length, along a direction inclined with respect to the direction x and to the direction y' (which length depends on the desired extent of the sliding member 210 along the direction y', as discussed below) and lying on a plane parallel to the plane x-y', and, in width, along the direction z'. In operation, the inclined guide 212 is adapted to slidably receive the cylinder 217 (or a part thereof, e.g. until the presence of the regulation screw 219 within the threaded hole $\mathbf{217}_H$ prevents further insertion of the cylinder 217 into the inclined guide 212) along direction z', the cylinder 217 thus resulting sliding coupled to the inclined guide 212.

The inclined guide 212 is preferably stadium shaped (in plan and sectional views), i.e. it is shaped as a rectangle with substantially semicircles at a pair of opposite sides. The semicircles advantageously define rounded end strokes of the inclined guide 212 to which the cylinder 217 is allowed to abut with a high adherence.

As better detailed below, the sliding or running of the cylinder 217 along the inclined guide 212 is caused by regulation screw 219 rotation, and determines the sliding of the sliding member 210 with respect to the support member 205, and hence the sliding of the decorative front panel 140',140" with respect to the door 122. In this regard, the inclination (i.e. slope) of the inclined guide 212 with respect to the direction x may be chosen according to specific design options, e.g. on the desired sliding extent of the sliding member 210, and/or on the size (e.g., the diameter) of the cylinder 217 (or of at least the part thereof that, in operation, is received in the inclined guide 212). Without losing generality, the inclination of the inclined guide 212 with respect to the direction x is lower than 90°, the inclination of the inclined guide 212 with respect to the direction x being preferably between 10° and 90°, more preferably between 25° and 75°, end even more preferably between 40° and 60°. Just as an example, the inclination of the inclined guide 212 with respect to the direction x is about 45°, as illustrated in the figures.

The support member 205 is preferably shaped such as to identify a housing for housing the regulation screw 219, preferably along the direction x (in any case, when other directions for the threaded hole $\mathbf{217}_H$ and the regulation screw 219 are envisaged, the housing may also be arranged differently), and allowing a substantially idle screw rotation when screwing and unscrewing it. As can be better appreciated in FIGS. 2A and 2C, the housing preferably comprises a first $\mathbf{207}_1$ and a second $\mathbf{207}_2$ slots, each one formed at a respective side wall $\mathbf{205}_{S1}$,$\mathbf{205}_{S2}$ of the support member 205 (the first $\mathbf{207}_1$ and second $\mathbf{207}_2$ slots being preferably aligned along the direction x).

According to the exemplary considered embodiment, the first $\mathbf{207}_1$ and second $\mathbf{207}_2$ slots are elongated in shape along the direction z, and the size of the first $\mathbf{207}_1$ and second $\mathbf{207}_2$ slots along the direction y' is preferably sufficiently larger than the diameter of the screw head to allow its passage through it and its rotation without affecting the structural integrity of the support member 205.

The second slot $\mathbf{207}_2$ is only partially visible in FIG. 2A. This because, according to an embodiment of the present invention, the second slot $\mathbf{207}_2$ is covered by an abutment portion $\mathbf{207}_{2,AB}$ for abutment of the screw head of the regulation screw 219 on it. Preferably, as illustrated, the abutment portion $\mathbf{207}_{2,AB}$ is hollow frustoconical in shape, and preferably has a first opening whose diameter is larger than the diameter of the screw head, and a second opening whose diameter is larger than the diameter of the screw body and smaller than the diameter of the screw head. In this way, the screw head is prevented from passing through the second opening, which prevents further insertion of the regulation screw 219 into the housing structure. As visible in FIGS. 2C and 2D, upon abutment of the screw head on the abutment portion $\mathbf{207}_{2,AB}$, the free end of the screw body (opposite the screw head) protrudes from the first slot $\mathbf{207}_1$, although this should not be construed limitatively.

As visible in FIGS. 2A-2D, the sliding member 210 also comprises an engaging element $\mathbf{210}_{SF}$ for engaging a respective bottom panel pin 145',145" of the decorative front panel 140',140". Preferably, as illustrated, the engaging element $\mathbf{210}_{SF}$ is a snap-fit element, the snap-fit element $\mathbf{210}_{SF}$ extending, for example, from the top edge of the sliding member body $\mathbf{210}_B$ along the direction y' (thus, in operation, the snap-fit element $\mathbf{210}_{SF}$ represents a top portion of the sliding member 210). Advantageously, the snap-fit element $\mathbf{210}_{SF}$ is made of the same material as the sliding member body $\mathbf{210}_B$, being preferably made in a single piece with it.

In its widest conception, the snap-fit element $\mathbf{210}_{SF}$ has first $\mathbf{210}_{SF1}$ and second $\mathbf{210}_{SF2}$ arms adapted to hold the bottom panel pin 145',145" therebetween.

In the exemplary illustrated embodiment, the snap-fit element $210_{SF}$ also has a third arm $210_{SF3}$, the first $210_{SF1}$, second $210_{SF2}$ and third $210_{SF3}$ arms being preferably parallel and aligned to each other along the direction x and upwards extending from the top edge of the sliding member body $210_B$ along the direction y'. Preferably, the first $210_{SF1}$ and/or second $210_{SF2}$ arms are deflectable or resilient arms (with the resiliency propriety that preferably results from the material they are made of and/or from their elongated shape) having, at free ends thereof, respective protrusions 211,213 each one projecting toward the protrusion of the other arm (preferably, without contact), whereas the third arm $210_{SF3}$ is a substantially bar-shaped arm whose extent along the direction y' is lower than that of the first $210_{SF1}$ and second $210_{SF2}$ arms.

In this way, the first $210_{SF1}$ and second $210_{SF2}$ arms, the protrusions 211,213, and the third arm $210_{SF3}$ substantially identify an engaging space intended to receive and engage the bottom panel pin 145',145" (e.g. its rod portion, as detailed herebelow).

The protrusions 211,213 preferably have a mutually complementary profile. More preferably, the protrusions 211,213 have oppositely-inclined walls that define a funnel-shape input of the engaging space, in a rest condition of the first $210_{SF1}$ and second $210_{SF2}$ arms (such as the condition illustrated in the top drawing of FIG. 2A and in the left drawings of FIGS. 2C and 2D) the funnel-shape input being smaller than the rod portion of the bottom panel pin 145', 145" so as to prevent its passage in absence of exerted forces.

The funnel-shape input of the engaging space is preferably smaller than the rod portion of the bottom panel pin 145',145". In this way, the force exerted by (e.g., the rod portion of) the bottom panel pin 145',145" against the protrusions 211,213 (which force is mainly due to decorative front panel 140',140" weight rather than being imparted with much effort by the operator or the user) determines resilient separation of the first $210_{SF1}$ and second $210_{SF2}$ arms from each other and from their rest position (i.e., the first $210_{SF1}$ and second $210_{SF2}$ arms are spread apart from one another). Upon entrance of the bottom panel pin 145',145" (i.e., of its rod portion) into the engaging space, and abutment on the tip (or free end) of the third arm $210_{SF3}$, the first $210_{SF1}$ and second $210_{SF2}$ arms, in absence of exerted force, get back to their rest position (so that the first $210_{SF1}$ and second $210_{SF2}$ arms, with the respective protrusions 211,213, that encloses laterally and from above the rod portion of the bottom panel pin 145',145", and with the third arm $210_{SF3}$ that firmly holds the rod portion of the bottom panel pin 145',145" from below).

Thus, in operation, when, in order to mount the decorative front panel 140',140" to the outer door panel 126, the panel pin 145',145" has to be snapped into the snap-fit element $210_{SF}$ mounted at the rear face of the of the outer door panel 126 in correspondence of the slot $126_S$, the following steps have to be carried out:

- the head portion of the panel pin 145',145" is made to pass through the enlarged end portion $126_{SC}$ of the slot $126_S$;
- the rod portion of the panel pin 145',145" is made to run along the elongated portion $126_{SE}$ until it is intercepted by the snap fit element $210_{SF}$ of the sliding member 210 (and, specifically, by the funnel-shape input of the engaging space);
- the force exerted by the rod portion of the bottom panel pin 145',145" against the protrusions 211,213 determines resilient separation of the first $210_{SF1}$ and second $210_{SF2}$ arms from each other, entrance of the rod portion of the bottom panel pin 145',145" into the engaging space, and snap-fit engaging by first $210_{SF1}$ and second $210_{SF2}$ arms movement back to their rest position and by third arm $210_{SF3}$ support from below).

Thus, the mounting of the decorative front panel 140', 140" is very easy, other than being easily reversible. In this respect, as should be readily understood, dismounting of the decorative front panel 140',140" from the outer door panel 126 only requires applying a lifting or pulling force on the decorative front panel 140',140" in the direction y' (i.e., parallel to the direction of the door 122 identified by its actual position—preferably, at least partially opened), until disengaging the bottom panel pin 145',145" from the snap-fit element $210_{SF}$, and causing the rod portion of the panel pin 145',145" to pass along the elongated portion $126_{SE}$ of the slot $126_S$ and then the head portion of the panel pin 145',145" to pass through the enlarged end portion $126_{SC}$ of the slot $126_S$ (in order to allow the head portion of the panel pin 145',145" to pass through the enlarged end portion $126_{SC}$, a force substantially orthogonal to the pulling force is preferably applied).

In order to make disengaging of the bottom panel pin 145',145" from the snap-fit element $210_{SF}$ very simple, the first arm $210_{SF1}$ (and/or, in an alternative embodiments of the present invention, the second arm $210_{SF2}$) is longer (along the direction y') than the second arm $210_{SF2}$ (and/or, respectively, the first arm $210_{SF1}$). The higher extent of the first arm $210_{SF1}$ forms a grip portion that the operator or the user can easily grab to easily and manually separate the first arm $210_{SF1}$ and the second arm $210_{SF1}$ from each other thereby allowing easy release of the bottom panel pin 145',145" from the engaging space (and, hence, decoupling of the decorative front panel 140',140" from the door 122). Additionally or alternatively, the protrusions 211,213 and/or the sides thereof facing the engaging space in the rest position of the first $210_{SF1}$ and second $210_{SF2}$ arms, may be shaped such as to promote the separation of the first $210_{SF1}$ and second $210_{SF2}$ arms from each other when a predetermined pulling force is applied.

As mentioned above, once the decorative front panel 140',140" is mounted to the outer door panel 126 (e.g., by snap-fitting of the panel pin 145',145" into the snap-fit element $210_{SF}$) the sliding of the sliding member 210 (and, hence, of the decorative front panel 140',140") is preferably carried out by acting on the regulation group 215 (e.g. by rotating the regulation screw 219, as detailed herebelow).

Figure 2B:
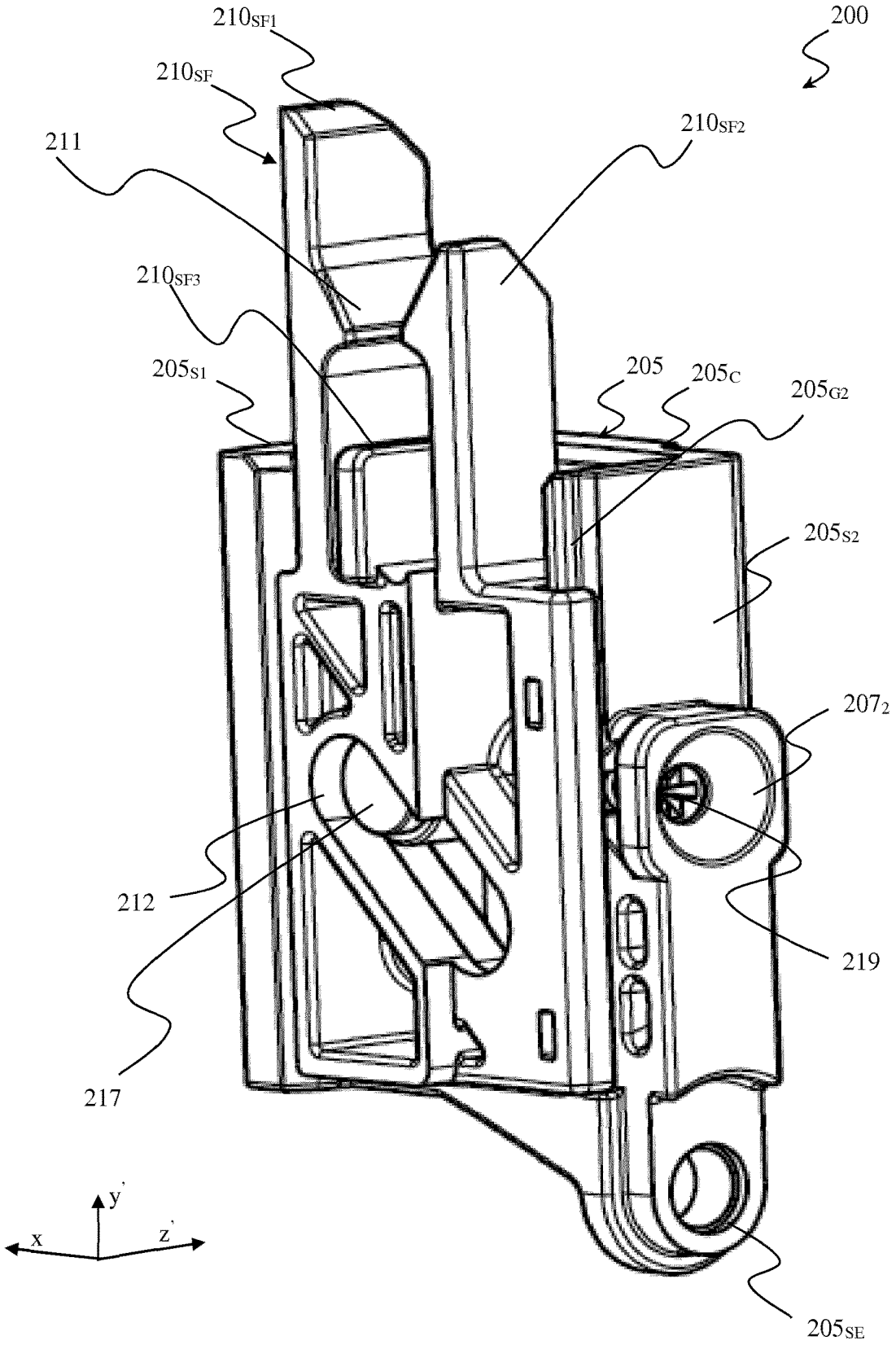
FIG. 2B shows a perspective view of the coupling system.
Figure 2C:
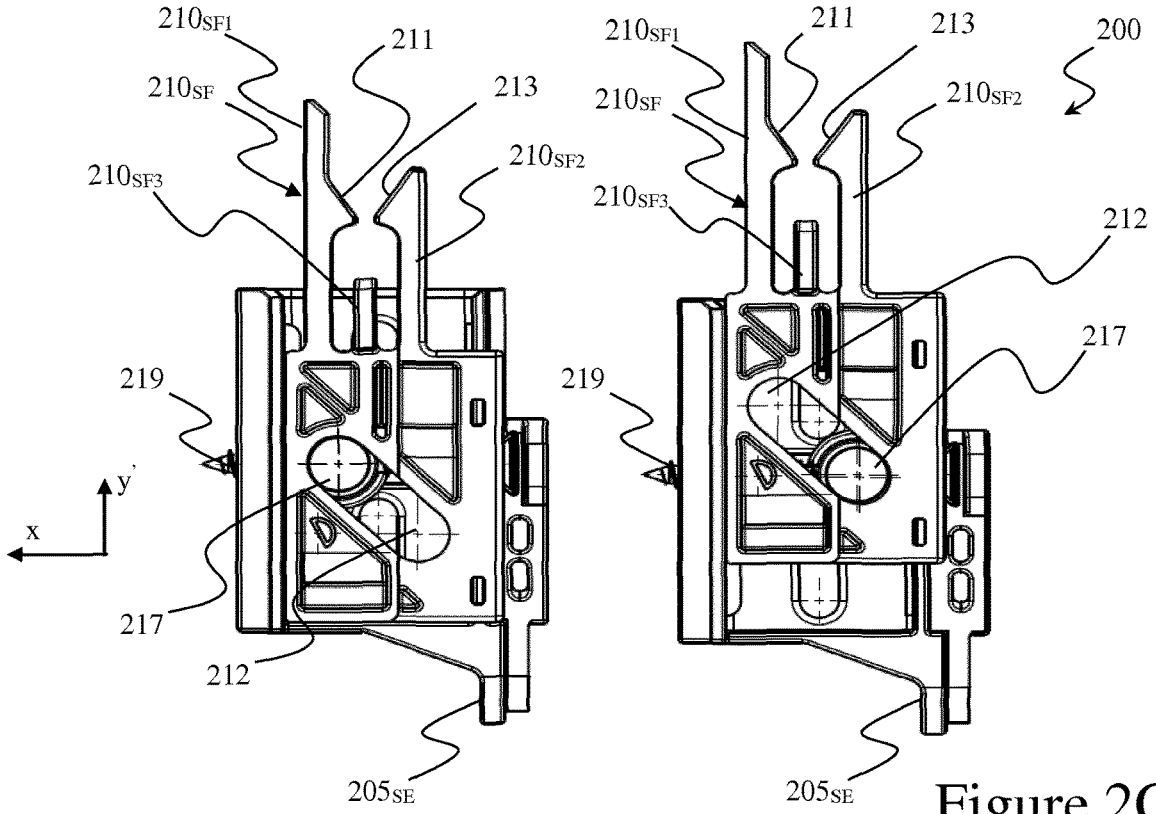
FIGS. 2C-2D show sectional views of the coupling system.
Figure 2D:
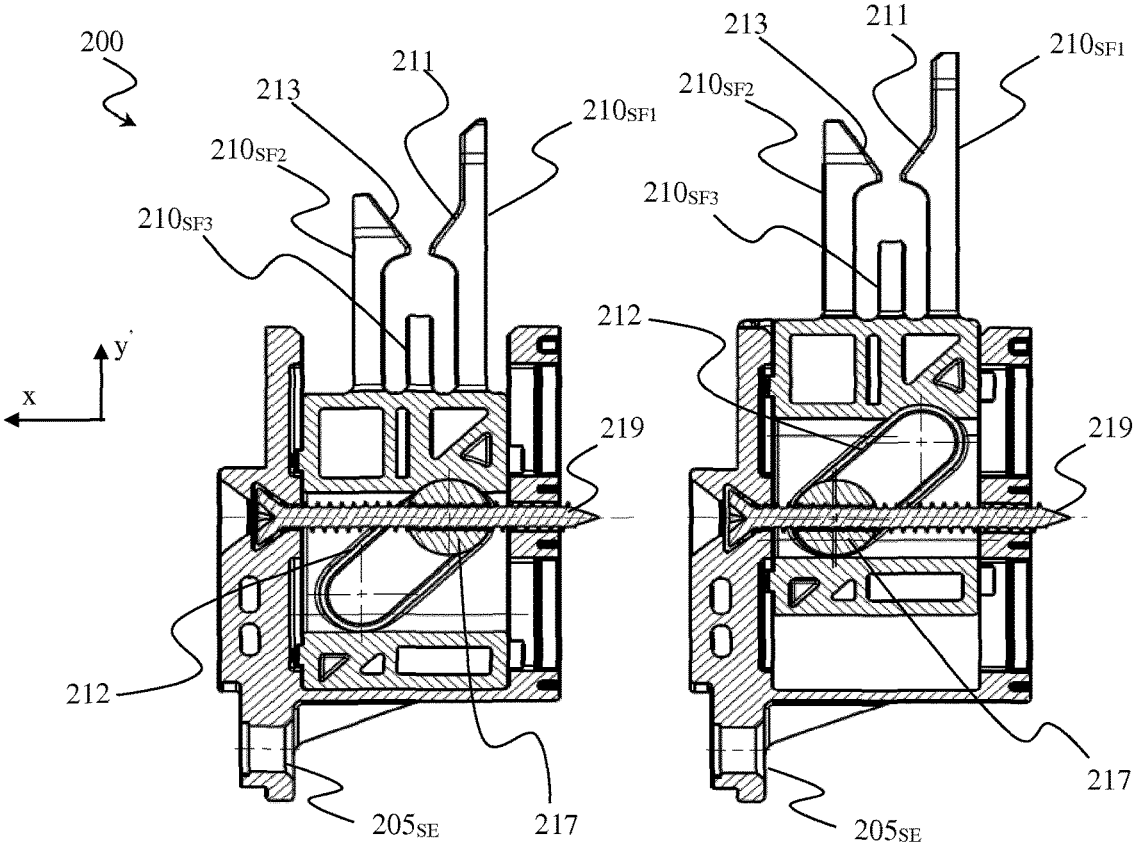

With particular reference to FIGS. 2C and 2D, when, in operation, the regulation screw 219 is inserted through the first $207_1$ and second $207_2$ slots of the support member 205, and through the through hole $217_H$ of the cylinder 217 (the cylinder 217 thus resulting interposed between the first $207_1$ and second $207_2$ slots), and the cylinder 217 is inserted in the inclined guide 212, the rotation of the regulation screw 219 (in the clockwise or anticlockwise direction) determines the sliding or translation or running of the cylinder 217 along the direction x (e.g., in the forward or backward direction, respectively). As the cylinder 217 is constrained to slide along the inclined guide 212 (which is part of the sliding member 210), a force acting along the direction x is exerted on the inclined guide 212 by the cylinder 217 upon regulation screw 219 rotation. Acting on an inclined plane (exactly, the inclined guide 212), this force has a force component acting along the direction y', which determines the sliding of the sliding member 210 in the direction y' (upwards or downwards, according to the translation direction along the direction x, and hence according to the rotation direction of the regulation screw 219).

Assuming for example the position of the sliding member 210 illustrated in the left drawings of FIGS. 2C and 2D, wherein the cylinder 217 is at a first end of the inclined guide 212 (the regulation screw 219 being for example completely unscrewed), the sliding member 210 is completely down (i.e. lowered). This translates in a lowered position (along direction y') of the decorative front panel 140',140" with respect to the door 122 (the lowered position depending on the positioning along the direction y', i.e. the height position from the floor, of the coupling system 200, and/or on the extent along the direction y', i.e. the height extent from the top edge of the sliding member body $\mathbf{210}_B$, of the snap-fit element $\mathbf{210}_{SF}$).

Preferably, the lowered position of the sliding member 210, and hence of the decorative front panel 140',140", is its default position. In order to achieve that, the engaging space of the snap-fit element $\mathbf{210}_{SF}$ is preferably positioned at the level (or substantially at the level) of the free end of the elongated portion $\mathbf{126}_{SE}$ (opposite the enlarged end portion $\mathbf{126}_{SC}$) of the associated slot $\mathbf{126}_S$.

Upon rotation of the regulation screw 219, for example by screwing it, the force component along the direction y' (i.e., the force component along the direction y' of the force exerted by cylinder 217 on the inclined guide 212), determines the sliding of the sliding member 210. This is illustrated in the right drawings of FIGS. 2C and 2D, wherein the cylinder 217 is at a second end of the inclined guide 212 opposite the first end (the regulation screw 219 being for example completely screwed), and the sliding member 210 is completely up (i.e., raised). This translates in a raised or lifted position (along direction y') of the decorative front panel 140',140" with respect to the lowered position (the raised or lifted position depending on the positioning along the direction y', i.e. the height position from the floor, of the coupling system 200, and/or on the extent along the direction y', i.e. the height extent from the top edge of the sliding member body $\mathbf{210}_B$, of the snap-fit element $\mathbf{210}_{SF}$, and or on the length of the inclined guide 212).

As mentioned above, the coupling system 200 may be fixed either to the door hinge 150 or directly to the rear face of the outer door panel 126. With particular reference to the illustrated coupling system 200, it is advantageously arranged for being fixed to the door hinge 150.

In this respect, as can be better appreciated in FIGS. 2A and 2B, the support member 205 comprises a eyelet $\mathbf{205}_{SE}$ adapted to receive a fastening member, such as a fastening screw, not shown. The eyelet $\mathbf{205}_{SE}$ preferably extends from a bottom edge of the side wall $\mathbf{205}_{S2}$ of the support member 205, the eyelet 205 more preferably lying on a plane parallel to the plane y'-z'.

Figure 3:
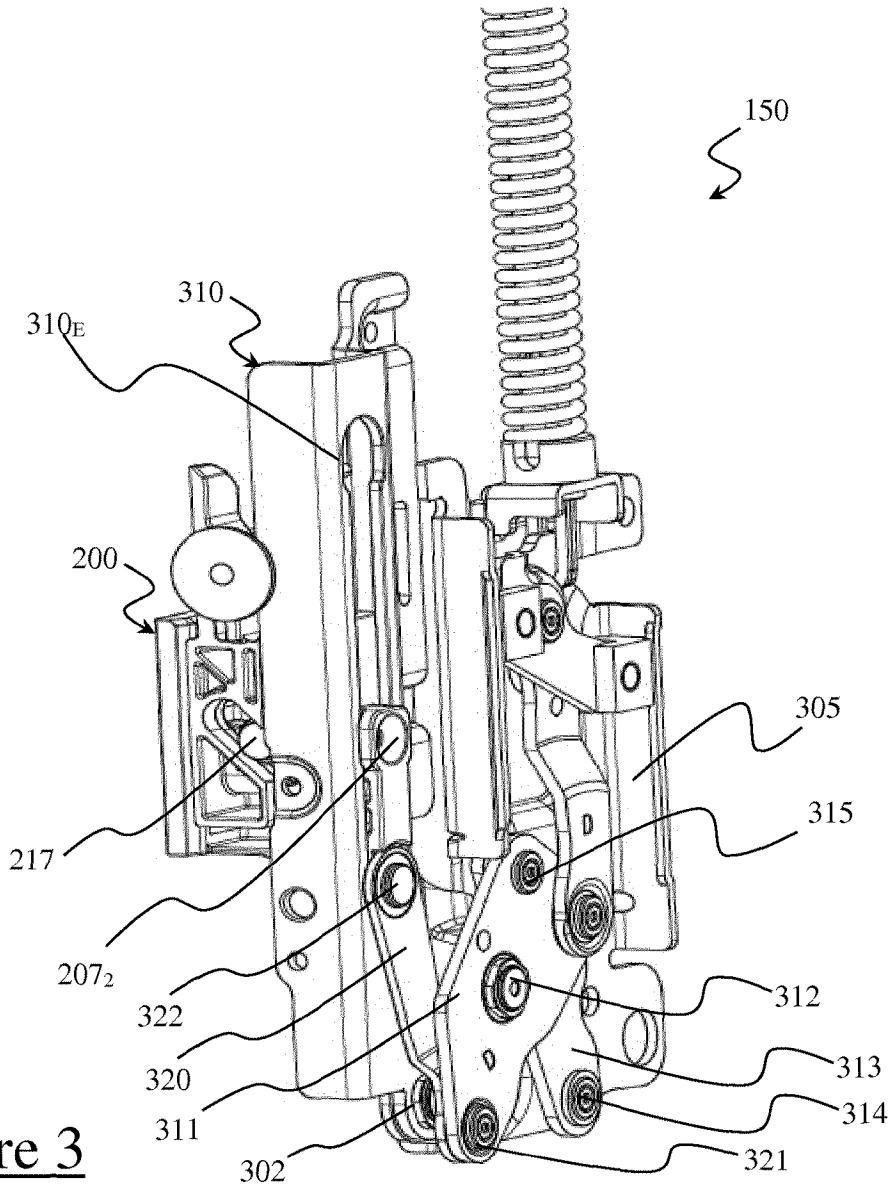
FIG. 3 shows perspective views of a door hinge with the coupling system fixed thereon according to an embodiment of the present invention.
Figure 3:
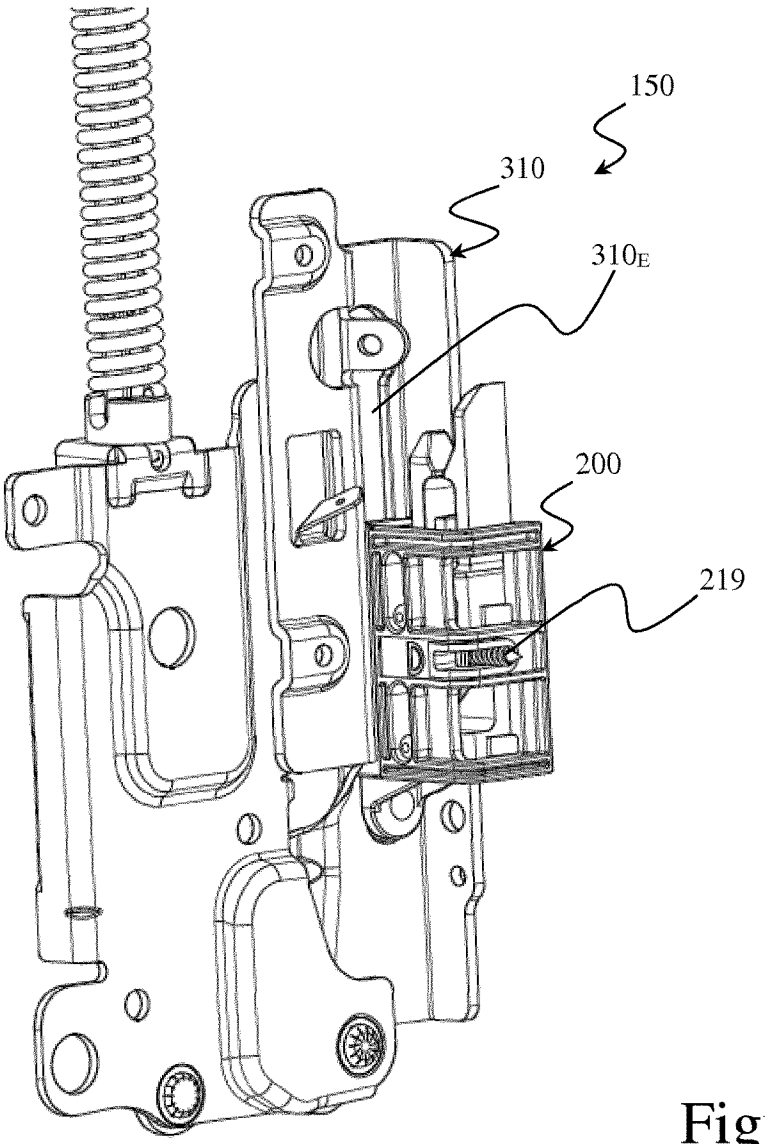

With reference now also to FIG. 3, it shows perspective views of the door hinge 150 with the coupling system 200 fixed thereon according to an embodiment of the present invention. More particularly, in the left and right drawings of FIG. 3 the door hinge 150 and the coupling system 200 fixed thereon are shown from different viewpoints (and specifically from back and side viewpoints, respectively).

Preferably, although not necessarily, the door hinge 150 is the same as that disclosed in EP2407723 (of the same Applicant), which will not be discussed again for the sake of conciseness and for which reference will be made only to elements thereof deemed relevant for the present invention.

The door hinge 150 comprises a support bracket 305 and a rotating bracket 310; the support bracket 305 and the rotating bracket 310 are used to connect the hinge 150 to the body 110 and to the door 122, respectively, of the dishwasher 100 (not shown in the figure)—for example, by means of corresponding screws.

Preferably, the rotating bracket 310 is rotationally connected to the support bracket 305 by means of a single fulcrum pin 302, only partially visible in the right drawing of FIG. 3; in this way, the door 122 (connected to the rotating bracket 310) can rotate with respect to the body 110 (connected to the support bracket 305) around the fulcrum pin 302, which then defines its rotation axis—in any case, as should be readily understood, the present invention equivalently applies to door hinges having more than one rotation axes (e.g., double fulcrum door hinges).

The hinge 150 also comprises a driving mechanism arranged to interact both with the support bracket 305 and the rotating bracket 310 to be operated when the rotating bracket 310 is rotating. The driving mechanism comprises a rocking arm 311 rotationally connected to the rotating bracket 310 around a rocking pin 312 arranged between an inner end of the rocking arm 311 in correspondence to the support bracket 305 and an outer end of the rocking arm 311 in correspondence to the rotating bracket 310, and a rotational coupling rotationally connecting the inner end of the rocking arm 311 to the support bracket 305 for rocking the rocking arm 311 around the rocking pin 312 during the rotation of the rotating bracket 310. The rotational coupling preferably comprises a guide arm 313 having a first guide arm end rotationally connected by means of a pin 314 to the support bracket 305 and a second guide arm end rotationally connected by means of pin 315 to the inner end of the rocking arm 311.

The rotating bracket 310 preferably comprises an elongated guide structure $\mathbf{310}_E$ extending substantially orthogonally to the rotation axis of the door 122.

As visible in the figure, the coupling system 200 is preferably connected to the elongated guide structure $\mathbf{310}_E$. More preferably, the coupling system 200 is connected to the elongated guide structure $\mathbf{310}_E$ such as to cooperate with the driving mechanism to achieve a sliding of the coupling system 200 along the elongated guide structure $\mathbf{310}_E$ and a corresponding sliding of the decorative front panel 140', 140" with respect to the 122 door during the rotation of the rotating bracket 310.

Preferably, the hinge 150 also comprises a crank mechanism 320 connecting the outer end of the rocking arm 311 to the eyelet $\mathbf{205}_{SE}$ of the support member 205 to achieve the sliding of the coupling system 200 along the elongated guide structure $\mathbf{310}_E$ and the corresponding sliding of the decorative front panel 140',140" with respect to the door during the rocking of the rocking arm 311.

Preferably, as illustrated, the crank mechanism comprises a transmission arm 320 having a first transmission arm end rotationally connected by means of pin 321 to the outer end of the rocking arm 311 and a second transmission arm end rotationally connected by means of pin 322 to the eyelet $\mathbf{205}_{SE}$.

The hinge 150 is particularly advantageous as it allows the coupling system 200 to slide along the elongated guide structure $\mathbf{310}_E$ (thus causing a corresponding sliding of the decorative front panel 140',140" with respect to the door 122) during the rotation of the rotating bracket. In any case, the proposed coupling system 200 lends itself to be fixed to any door hinge.

As can be appreciated in FIG. 1B and in the right drawing of FIG. 3, in the exemplary considered embodiment, the eyelet $\mathbf{205}_{SE}$ of the support member 205 is shaped and positioned such that, when the door hinge 150 is coupled to the door 122, the regulation screw 219 can be accessed from a side of the dishwasher 100.

As mentioned above, alternative embodiments of the present invention, not shown, provide that the coupling system 200 is fixed directly on the rear face of the outer door panel 126. In order to achieve that, the outer door panel 126 (i.e., the rear face thereof) may be provided with a bracket (not shown) for fixing to the eyelet $\mathbf{205}_{SE}$, or the eyelet of the support member may be arranged on a plane parallel to the plane x-y'.

Thanks to the present invention, the regulation of the decorative front panel 140',140" does not require lifting the decorative front panel 140',140" and keeping it in position by hands while it is screwed to the dishwasher 100. On the contrary, thanks to the present invention, the operator or the user can regulate easily and in a short time the decorative front panel 140',140" only acting on the regulation screw 219, and without any assistance of one or more other operators or users.

Furthermore, the simplicity of the regulation makes the present invention profitably usable also in some unfavorable scenarios, such as when the dishwasher 100 is located at an end of the kitchen (e.g. near a lateral wall), which scenario typically involves a reduced available space that considerably limits the freedom of movement of the operator or user.

Naturally, in order to satisfy local and specific requirements, a person skilled in the art may apply to the solution described above many logical and/or physical modifications and alterations. More specifically, although this solution has been described with a certain degree of particularity with reference to one or more embodiments thereof, it should be understood that various omissions, substitutions and changes in the form and details as well as other embodiments are possible (for example, with respect to process parameters, materials, and dimensions). Particularly, different embodiments of the invention may even be practiced without the specific details (such as the numerical examples) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the disclosed solution may be incorporated in any other embodiment as a matter of general design choice.

The invention claimed is:

1. A dishwasher comprising:

a frame defining a treatment chamber for items to be washed;

a door for selectively accessing the treatment chamber, the door comprising a door panel; and at least one coupling system for coupling a decorative front panel to the door panel, the at least one coupling system comprising:

a support member coupled to the door panel, a sliding member coupled to the decorative front panel and slidably coupled to the support member for sliding with respect and parallel thereto, such that the sliding of the sliding member with respect to the support member causes the sliding of the decorative front panel with respect to the door panel, and a regulation group comprising a rotatable regulation member that can be rotated by a user, and a conversion member coupled to the regulation member and to the sliding member for converting a rotation of the regulation member into said sliding of the sliding member, wherein the sliding member comprises an engaging element for engaging a respective panel pin of the decorative front panel.

2. Dishwasher according to claim 1, wherein the engaging element is a snap-fit element for the snap-fit engagement of said panel pin.

3. Dishwasher according to claim 1, wherein the engaging element comprises at least first and second arms adapted to hold the panel pin therebetween.

4. Dishwasher according to claim 3, wherein at least one of the first arm and the second arm comprises a grip portion adapted to manually separate the first arm and the second arm from each other thereby allowing release of the panel pin and decoupling of the decorative front panel from the door panel.

5. A dishwasher comprising:

a frame defining a treatment chamber for items to be washed;

a door for selectively accessing the treatment chamber, the door comprising a door panel; and at least one coupling system for coupling a decorative front panel to the door panel, the at least one coupling system comprising:

a support member coupled to the door panel, a sliding member coupled to the decorative front panel and slidably coupled to the support member for sliding with respect and parallel thereto, such that the sliding of the sliding member with respect to the support member causes the sliding of the decorative front panel with respect to the door panel, and a regulation group comprising a rotatable regulation member that can be rotated by a user, and a conversion member coupled to the regulation member and to the sliding member for converting a rotation of the regulation member into said sliding of the sliding member, wherein the conversion member comprises a cylinder and the regulation member comprises a regulation screw fitted into a threaded hole of the cylinder along a first direction (x) orthogonal to a sliding direction (y') of the sliding member, and wherein the sliding member comprises a guide extending along a second direction inclined with respect to the first direction (x) and to the sliding direction (y') and being adapted to slidably receive the cylinder, whereby the rotation of the regulation screw causes the cylinder to slide along the guide and the sliding of the cylinder determines the sliding of sliding member.

6. Dishwasher according to claim 1, wherein the support member comprises a substantially U-shaped support member having opposite first and second walls projecting from respective edges of a third wall, and wherein the support member comprises first and second sliding grooves at free ends of said first and second side walls, respectively, first and second edges of the sliding member being designed to slidably engage said first and second sliding grooves, respectively, thereby allowing sliding of the sliding member along them.

7. Dishwasher according to claim 1, wherein the door panel comprises at least one slot allowing the passage of a respective panel pin through it, each slot extending between a rear face of the door panel facing the treatment chamber when the door is closed and a front face of the door panel opposite the rear face, and wherein each coupling system is arranged at the rear face of the door panel in correspondence of a respective slot so as to engage the respective panel pin protruding from the rear face of the door panel upon its passage through the slot.

8. Dishwasher according to claim 7, wherein said at least one slot has an enlarged end portion for allowing passage of a head portion of a respective panel pin therethrough, and an elongated portion for allowing movement/sliding of a rod portion of the panel pin along it, the sliding of the sliding member being allowed by the sliding of the panel pin along the slot.

9. Dishwasher according to claim 6, wherein the support member comprises a housing for housing the regulation member and allowing an idle rotation thereof.

10. Dishwasher according to claim 9, wherein said housing comprises a first and a second slots formed at the first and second side walls of the support member, respectively.

11. Dishwasher according to claim 1, wherein the support member comprises an eyelet extending from a bottom edge of the support member, said eyelet being adapted to receive a fastening member for fastening the support member to the door panel.

12. Dishwasher according to claim 1, wherein the coupling system is fixed to the rear face of the door panel.

13. A dishwasher comprising:

a frame defining a treatment chamber for items to be washed;

a door for selectively accessing the treatment chamber, the door comprising a door panel;

at least one coupling system for coupling a decorative front panel to the door panel, the at least one coupling system comprising:

a support member coupled to the door panel, a sliding member coupled to the decorative front panel and slidably coupled to the support member for sliding with respect and parallel thereto, such that the sliding of the sliding member with respect to the support member causes the sliding of the decorative front panel with respect to the door panel, and a regulation group comprising a rotatable regulation member that can be rotated by a user, and a conversion member coupled to the regulation member and to the sliding member for converting a rotation of the regulation member into said sliding of the sliding member; and at least one door hinge for rotationally coupling the door to the frame, the at least one coupling system being fixed to a respective door hinge.

* * * * *